US006295776B1

(12) United States Patent
Kunz et al.

(10) Patent No.: US 6,295,776 B1
(45) Date of Patent: Oct. 2, 2001

(54) CORNER BEAD DRYWALL TRIM AND METHOD OF MANUFACTURE

(75) Inventors: Roland Kunz, Omaha, NE (US); Roy R. Rantilla, Niles, OH (US)

(73) Assignee: Phillips Manufacturing Co., Omaha, NE (US)

( * ) Notice: Subject to any disclaimer, the term of this patent is extended or adjusted under 35 U.S.C. 154(b) by 0 days.

(21) Appl. No.: 09/573,022

(22) Filed: May 17, 2000

(51) Int. Cl.[7] ..... E04B 1/00; E04F 13/06

(52) U.S. Cl. ..... 52/255; 52/256; 52/745.19; 52/746.1; 156/153; 156/71

(58) Field of Search ..... 52/254–257, 745.19, 52/746.1; 156/153, 71

(56) References Cited

U.S. PATENT DOCUMENTS

| | | | | |
|---|---|---|---|---|
| 2,234,701 | | 3/1941 | Lyman | 72/121 |
| 3,090,087 | | 5/1963 | Miller | 20/92 |
| 3,109,207 | | 11/1963 | Cooper | 20/92 |
| 4,863,774 | | 9/1989 | Tucker | 428/77 |
| 4,876,837 | | 10/1989 | Kelly et al. | 52/287 |
| 4,977,718 | | 12/1990 | Hoffman | 52/288 |
| 5,037,686 | | 8/1991 | Conboy | 428/43 |
| 5,048,247 | | 9/1991 | Weldy | 52/255 |
| 5,131,198 | * | 7/1992 | Rithcie et al. | 52/287.1 |
| 5,390,458 | | 2/1995 | Menchetti | 52/99 |
| 5,613,335 | | 3/1997 | Rennich et al. | 52/255 |
| 5,836,122 | | 11/1998 | Rennich et al. | 52/254 |
| 5,881,520 | * | 3/1999 | Blazevic | 52/281 |
| 6,148,573 | * | 11/2000 | Smythe, Jr. | 52/255 |

FOREIGN PATENT DOCUMENTS 153625 10/1953 (AU) .

* cited by examiner

*Primary Examiner*—Robert Canfield
(74) *Attorney, Agent, or Firm*—Koley Jessen P.C. A Limited Liability Organization; Mark D. Frederiksen

(57) ABSTRACT

A corner bead is of the tape-on type, having an elongated metal core strip with a longitudinal arcuate nose and a pair of flanges extending outwardly from the nose at approximately a right angle. A cover strip of paper is bonded to the exterior surface of the core strip, and includes wings which project outwardly beyond the extent of the flanges. The cover strip is formed of a stock paper having high abrasion resistance, tensile strength, and which is dimensionally stable on contact with wet joint compound. The surface of the cover strip is abraded to partially loosen the surface fibers, which will increase the bond strength of the comer bead when installed on wallboard. The method of manufacturing a tape-on corner bead includes the steps of conditioning a strip of stock paper by abrading the surfaces of the paper, and then bonding the paper strip to an outward face of an elongated core.

18 Claims, 2 Drawing Sheets

CORNER BEAD DRYWALL TRIM AND METHOD OF MANUFACTURE

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to drywall construction, and more particularly to an improved corner bead strip with paper wings and a method for the manufacture thereof.

(2) Background Information

Current building construction utilizes sheets of drywall, commonly referred to as "wallboard", to form the surfaces of interior walls of buildings. Drywall, or wallboard, is formed of sheets of plaster which are sheathed in an outer wrapping of heavy construction paper.

In wallboard construction, the joint between adjacent sheets of wallboard is usually covered by a paper tape extending lengthwise along the joint. The conventional drywall tape is provided in narrow elongated strips of porous paper wound into rolls. The drywall tape is applied to the joints, and then covered with wet plaster or "mud". The plaster is feathered and smoothed along the edges of the tape to conceal the tape edges and form a smooth unmarred surface where the wallboard adjoins.

It is often necessary to cut the wallboard to form a corner, which thereby exposes the plaster contained between the heavy paper sheets. This exposed plaster tends to crumble unless these edges are protected. To finish exterior corners in wallboard construction, metal comer beads are typically installed. Such corner beads are conventionally formed by rollforming from an elongated strip of sheet metal, and provide a rounded nose with two mounting flanges extending at substantially right angles from the opposing sides of the nose. These mounting flanges are often knurled or embossed to provide a rough surface so that the joint compound will adhere when the corner is finished.

The corner bead is installed by securing the mounting flanges along the surface of the drywall panels adjacent to the corner by nails or the like. Wet plaster is then smoothed into place to cover the metal flanges, and edges of the plaster are smoothed and feathered to cover and conceal the metal edges.

A second type of corner bead is referred to as a "tape-on" bead. Tape-on comer beads utilize paper wings to secure a metal comer angle in position, rather than using riails or other fasteners. Wet plaster or joint cement for finishing the corner will normally adhere significantly better to the paper cover strip of tape-on beads, than to the exposed metal of conventional nail-on beads. Nail-on beads are also typically more susceptible to developing crack lines along the outer edges of the flanges, than are tape-on beads. In addition, tape-on beads are more tolerant of dimensional and geometric changes in the underlying construction framing than are nail-on beads with their rigid mechanical attachment to the construction framing.

One of the main problems with prior art tape-on bead is the use of standard joint/drywall tape-on the bead. Such drywall tape is very fibrous, which is good for bond strength, but poor for appearance. During the application of joint cement over the tape, to adhere the corner bead to the drywall, fibers will project and protrude with only minimal contact by the application tools. These fibers will ball up during the course of sanding of the joint cement for the final finish, thereby detracting from the finished appearance of the corner.

One method for improving protection against adverse abrasion of this paper strip is disclosed in U.S. Pat. Nos. 5,613,335 and 5,836,122, both to Rennich et al. These patents disclose a paper bead (tape-on bead) utilizing a paper layer which is uniformly impregnated throughout its thickness with latex or similar strengthening compound with a high wet strength so as to make the paper strip resistant to scuffing and abrasion throughout its thickness. This impregnated stock paper would have a high pick resistance or surface fiber bond, and would effectively inhibit the separation of surface fibers during application on wallboard, thereby providing a good finished appearance in installation. However, the applicants herein have found that paper of this type, which has been impregnated with latex or the like, exhibits poor joint compound bonding properties. Bond Strength Test ASTM C 474 is required by specifications ASTM C 475 and ASTM C 1047 for wallboard accessories manufactured from steel and paper in combination. This ASTM test observes the result of peeling the paper away from a joint compound bond made under controlled conditions.

BRIEF SUMMARY OF THE INVENTION

It is therefore a general object of the present invention to provide an improved tape-on corner bead with paper wings which exhibits high bond strength.

Yet another object is to provide an improved tape-on comer bead which will firmly bond to the drywall construction, the supporting metal corner angle, as well as the joint cement applied over the top thereof.

A further object of the present invention is to provide a method for constructing tape-on corner bead which permits secure attachment of the corner bead to wallboard.

These and other objects will be apparent to those skilled in the art.

The corner bead of the present invention is of the tape-on type, having an elongated metal core strip with a longitudinal arcuate nose and a pair of flanges extending outwardly from the nose at approximately a right angle. A cover strip of paper is bonded to the exterior surface of the core strip, and includes wings which project outwardly beyond the extent of the flanges. The cover strip is formed of a stock paper having high abrasion resistance, tensile strength, and which is dimensionally stable on contact with wet joint compound. The surface of the cover strip is abraded to partially loosen the surface fibers, which will increase the bond strength of the comer bead when installed on wallboard. The method of manufacturing a tape-on corner bead includes the steps of conditioning a strip of stock paper by abrading the surfaces of the paper, and then bonding the paper strip to an outward face of an elongated core.

BRIEF DESCRIPTION OF THE SEVERAL VIEWS OF THE DRAWING

The preferred embodiment of the invention is illustrated in the accompanying drawings, in which similar or corresponding parts are identified with the same reference numeral through out the several views, and in which.

DETAILED DESCRIPTION OF THE INVENTION

Figure 1:
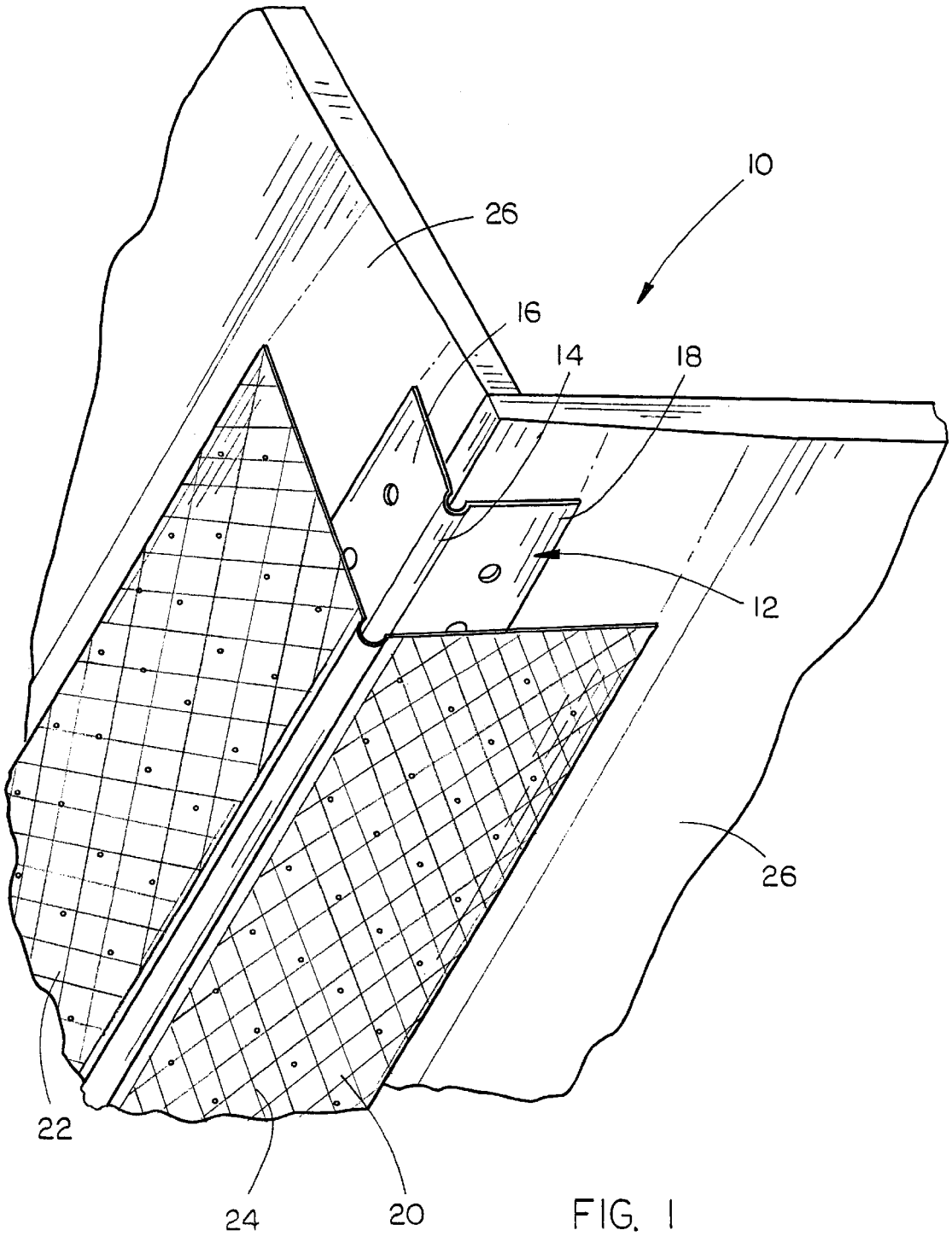
FIG. 1 is a perspective view of the corner bead of the present invention exploded away from an exterior corner of wallboard construction.
Figure 3:
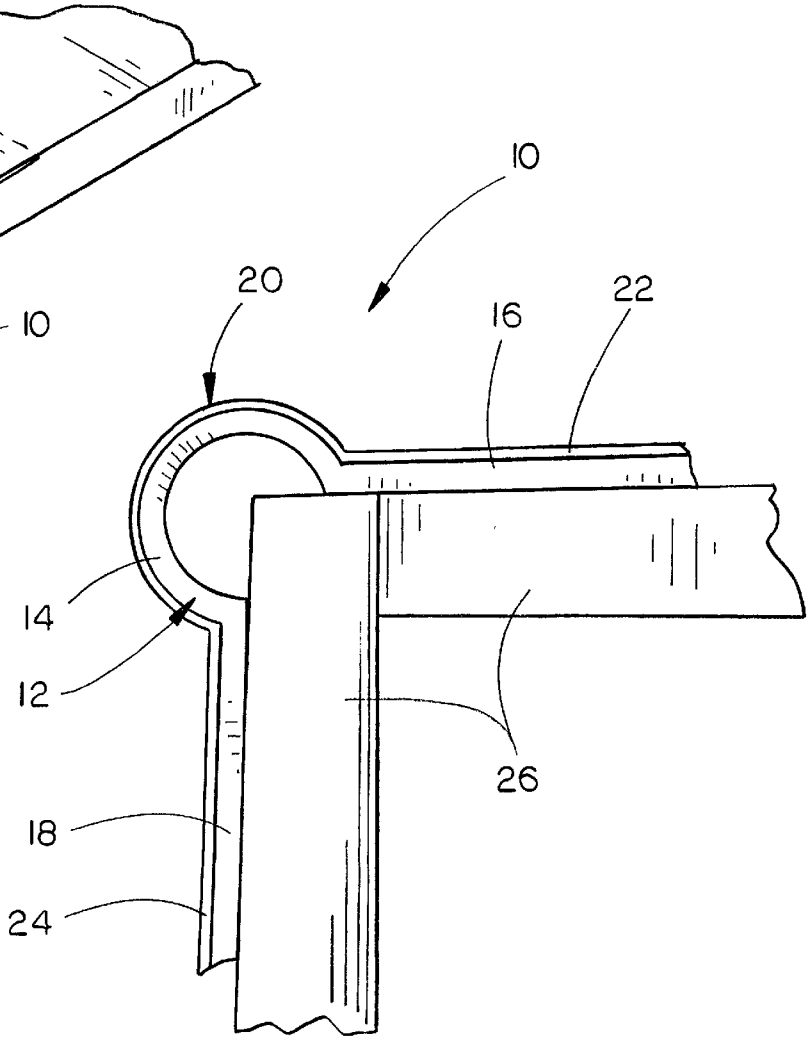
FIG. 3 is an enlarged top view of the corner bead mounted on a corner of wallboard construction.
Figure 2:
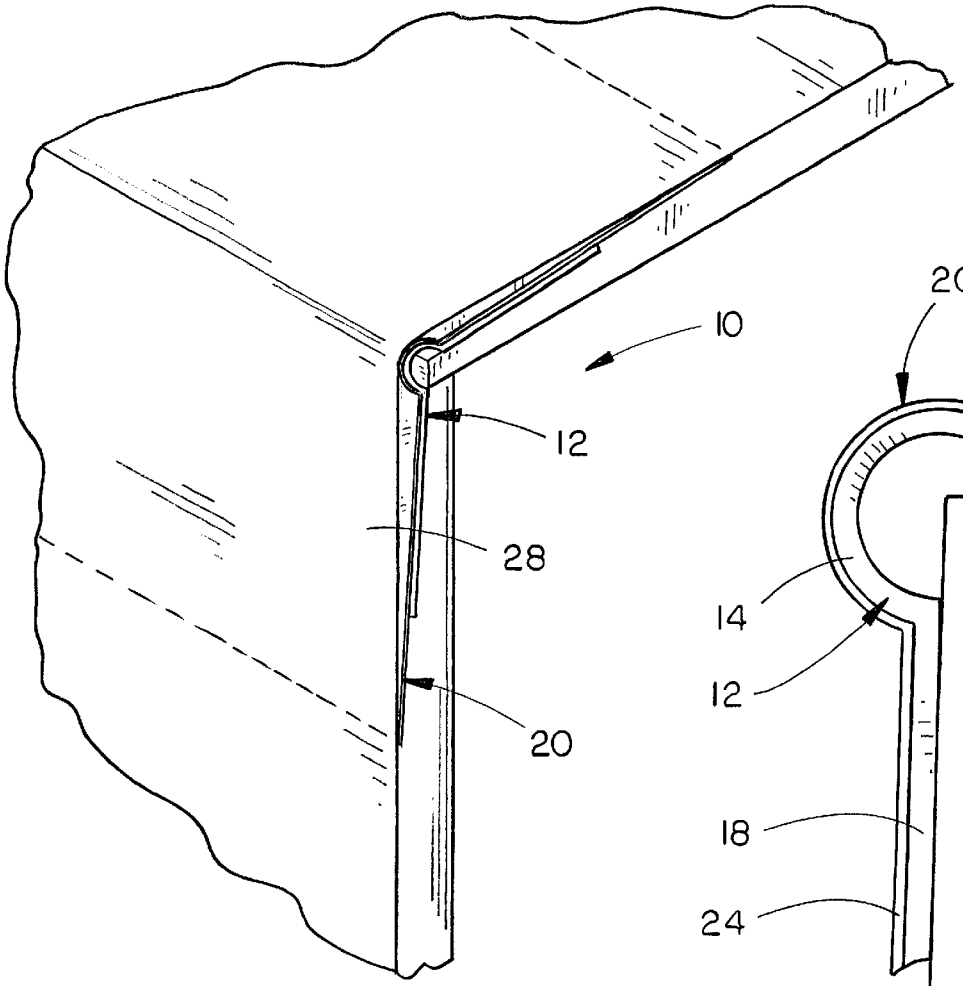
FIG. 2 is a perspective view of a corner of wallboard construction with the corner bead of the present invention thereon, and covered with joint cement for a finished surface.

Referring now to the drawings, a corner bead of the present invention is designated generally at 10 and includes an elongated metal core strip 12 formed with a central arcuate longitudinal channel forming a nose 14, with flanges 16 and 18 extending outwardly from each edge of the channel of nose 14 at an approximate right angle.

Core strip 12 is preferably a galvanized steel strip having a thickness of approximately 0.014 inches which has been roll-formed. In the preferred embodiment, the flanges are ¾ of an inch in length, measured from nose 14. The typical core strip nose will have an outside radius of up to about 1.5 inches, and project outwardly from the plane of the flanges approximately 0.033 inches, to provide space to receive joint cement, to cover and "dress" the corner.

In the method of assembly of the corner bead, a continuous steel strip first passes through a preforming roll forming section. The preforming section, by means of progressive contoured rolls, forms the steel core strip 12 into a cross-section that begins to conform to the desired finished shape of the corner bead. This preform steel strip then progresses into an assembly section.

A continuous length of paper strip enters a paper conditioning section, wherein mechanical abrasion breaks some of the surface bond of the paper fibers and simultaneously, by means of a roller die, pierces a plurality of small apertures through designated regions of the paper. The conditioned paper strip then progresses to the assembly section for attachment to the preform core.

In the assembly section, the conditioned paper strip is guided through a preheating section that brings the paper to a suitable elevated temperature to improve the subsequent adhesive bonding. It then passes against a slot type hot melt adhesive applicator head, which applies a stripe of adhesive to the paper. The design of the slot head, along with control over the relative travel speed of the paper strip and the rate of flow of adhesive, regulate the location, width and thickness of the adhesive stripe. The heated paper strip with adhesive thereon is then guided into contact with the steel core preform. The assembly of steel core preform, adhesive and paper strip then progresses into a finish forming section.

In the finish forming section, the assembly passes through a second series of contoured forming rolls. These rolls form the assembly into the desired finished crosssection shape of the corner bead, and simultaneously provides the necessary pressure to achieve the bond between the paper strip 20 and steel core strip 12. The bonded and formed corner bead then progresses to a cut off section where the corner bead 10 is sheared into the desired finished length.

The selection of the paper of paper strip 20 is critical to the invention. Conventional joint tape paper has low pick resistance, which results in good bond strength with joint compound, but produces a product that is difficult to finish. The scraping and sanding that occur in drywall finishing will separate the surface fibers of the paper, resulting in balling and/or protruding fibers and a resulting poor finished appearance.

A stock paper impregnated with latex, or other strengthening compound, to a relatively uniform concentration through its thickness would have a high pick resistance or surface fiber bond. Thus, the impregnated paper would effectively inhibit the separation of surface fibers during drywall application, and would provide a good finished appearance in installation. This type of paper is described in U.S. Pat. Nos. 5,613,335 and 5,836,122, described above. However, the inventors herein have found that such paper performs poorly when installed on wallboard and subjected to tests which measure resistance to peeling.

Another particular type of paper which was tested was wallpaper stock (or hanging stock). This type of paper is impregnated from one side with a polymer intended to make the paper printable and scuff resistant, while the opposite side of the paper remains highly bondable. While these are highly desirable properties, the wallpaper stock is not suitable because of a lack of dimensional stability. The paper expands considerably on exposure to moisture, which causes a buckled appearance when imbedded in joint compound.

The preferred paper stock therefore must have a high pick resistance, high tensile strength, and be dimensionally stable on contact with wet joint compound. The inventors herein have found that a paper produced by E. B. Eddy's (Domtar) brand code 5520/150 GSM Sand Back meets all of these requirements. This paper is produced without the impregnation of latex or other strengthening compound, and was designed for use as a sandpaper backing stock. Tests have been conducted both with plain white paper, as well as colored samples, utilizing the method of assembly as described above. When the paper stock is conditioned by abrading the surface to partially loosen the surface fibers, the inventors have found that the conditioned paper has passed the ASTM C 474 blond strength test, as performed at the inventors' facility. Thus, a combination of the appropriate paper with the method of assembly into corner bead and installation on wallboard, combine to form the desired comer bead with a higher peel bond strength when installed on wallboard.

As shown in the drawings, the preferred embodiment of the invention utilizes a paper cover strip 20 with wings 22 and 24 affixed to flanges 16 and 18 respectively, and extending beyond flanges 16 and 18. The paper preferably has a thickness of approximately 0.007 inches and will project beyond flanges 16 and 18 approximately ⅝ of an inch. A plurality of very small diameter holes, preferably 0.005 to 0.02 inches in diameter are punched through the cover strip to assist in adhering the paper strip to the wallboard 26, the core strip 12, and joint cement 28 applied to the exterior surface thereof. The inventors have found that paperwith an off-white tint is preferable, so as to match the color of the drywall facing paper and joint cement. In this way, if a portion of the joint cement is sanded away to reveal the paper strip, the color of the paper strip will closely match the color of the wallboard and will not reveal any stark contrasts.

The corner bead 10 is applied in the conventional manner for tape-on beads. Once the joint cement covering the cover strip 20 from nose 14 outwardly over wings 22 and 24, has dried, the joint cement is sanded.

Whereas the invention has been shown and described in connection with the preferred embodiment thereof, many modifications, substitutions and additions may be made which are within the intended broad scope of the appended claims. More specifically, this invention may be applied to all varieties of drywall accessory or trim, including those types described in ASTM C 1047.

We claim:

1. A method for manufacturing a tape-on corner bead, comprising the steps of:

conditioning a strip of a stock paper by abrading the surfaces of the paper; and bonding the paper strip to an outward face of an elongated core.

2. The method of claim 1, wherein said abrading step includes breaking some of the surface bond of the paper fibers in the strip.

3. The method of claim 2, wherein the conditioning step further includes the step of forming a plurality of spaced apart apertures through at least a portion of said strip.

4. The method of claim 3, wherein said apertures are spaced uniformly apart and have diameters of about 0.005 to 0.020 inches.

5. The method of claim 4, wherein the bonding step includes the steps of:

applying a continuous stripe of adhesive to one of said paper strip and the core; and applying pressure to the core and paper strip.

6. The method of claim 5, wherein the bonding step further includes the step of heating the paper to a predetermined temperature prior to the step of applying the adhesive stripe.

7. The method of claim 6, further comprising the steps of:

roll forming the core to a preform shape with a cross-sectional shape that begin to conform to the desired finished cross-sectional shape, prior to the bonding step; and wherein the step of applying pressure includes passing the core and paper strip through a series of contoured forming rolls to form the core and attached strip into the desired finished cross-sectional shape.

8. The method of claim 7, wherein the core is metal.

9. The method of claim 1, wherein the conditioning step further includes the step of forming a plurality of spaced apart apertures through at least a portion of said strip.

10. The method of claim 9, wherein said apertures are spaced uniformly apart and have diameters of about 0.005 to 0.020 inches.

11. The method of claim 1, wherein the bonding step includes the steps of:

applying a continuous stripe of adhesive to one of said paper strip and the core; and applying pressure to the core and paper strip.

12. The method of claim 11, wherein the bonding step further includes the step of heating the paper to a predetermined temperature prior to the step of applying the adhesive stripe.

13. The method of claim 11, further comprising the steps of:

roll forming the core to a preform shape with a cross-sectional shape that begins to conform to the desired finished cross-sectional shape, prior to the bonding step, and wherein the step of applying pressure includes passing the core and paper strip through a series of contoured forming rolls to form the core and attached strip into the desired finished cross-sectional shape.

14. The method of claim 1, wherein the stock paper is formed of kraft fibers, has a high pick resistance, high tensile strength, and is dimensionally stable in contact with wet joint cement.

15. A tape-on corner bead for drywall construction, comprising:

an elongated core strip having a longitudinal arcuate channel forming a nose, and a pair of flanges extending outwardly from each side of the nose;

a cover strip affixed to an outward face of the core strip, with wings extending beyond the extent of the flanges; and said cover strip formed of a stock paper of kraft fibers which is dimensionally stable when in contact with wet joint cement;

said cover strip having abraded surfaces so that the paper has a high pull bond strength when installed on drywall.

16. The corner bead of claim 15, wherein the cover strip is perforated with a plurality of apertures having diameters of approximately 0.005 to 0.020 inches.

17. The corner bead of claim 15, wherein the core strip is metal.

18. The corner bead of claim 17, wherein the metal is galvanized steel.

* * * * *